US008124901B2

(12) United States Patent
Toba et al.

(10) Patent No.: US 8,124,901 B2
(45) Date of Patent: Feb. 28, 2012

(54) ENERGY STORAGE MECHANISM FOR SWITCHING DEVICE

(75) Inventors: Shinji Toba, Kagawa (JP); Minoru Kobayashi, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 456 days.

(21) Appl. No.: 12/520,396

(22) PCT Filed: Mar. 27, 2007

(86) PCT No.: PCT/JP2007/056395

§ 371 (c)(1),
(2), (4) Date: Jun. 19, 2009

(87) PCT Pub. No.: WO2008/117438

PCT Pub. Date: Oct. 2, 2008

(65) Prior Publication Data

US 2010/0025215 A1 Feb. 4, 2010

(51) Int. Cl.
*H01H 3/40* (2006.01)
*H01H 5/00* (2006.01)

(52) U.S. Cl. ..... 200/400; 200/501

(58) Field of Classification Search ..... 200/400, 200/500, 501; 74/2

See application file for complete search history.

(56) References Cited

U.S. PATENT DOCUMENTS

| | | | | |
|---|---|---|---|---|
| 6,441,329 | B2 * | 8/2002 | Guille et al. | 200/400 |
| 7,319,203 | B1 * | 1/2008 | Briggs et al. | 200/400 |
| 2008/0296137 | A1 * | 12/2008 | Chen et al. | 200/400 |

FOREIGN PATENT DOCUMENTS

| | | | |
|---|---|---|---|
| JP | 11-040010 | A | 2/1999 |
| JP | 2001-210196 | A | 8/2001 |

OTHER PUBLICATIONS

PCT/ISA/210 for PCT/JP2007/056395 completed Jun. 26, 2007.

* cited by examiner

*Primary Examiner* — Felix O Figueroa

(74) *Attorney, Agent, or Firm* — Buchanan Ingersoll & Rooney PC

(57) ABSTRACT

There is obtained an energy storage mechanism, for a switching device, that has a structure requiring no high-accuracy components and can perform release of driving-power transmission and re-engagement. In the case where the closing spring 22 is energized, the main gear 5 is rotated by the energy storage motor 3 or manually, via the output gear 16 and the intermediate gear 33; in the case where the closing spring 22 has been energized, the engagement between the intermediate gear 33 and the main gear 5 is released at a missing-tooth portion 34 of a gear B; in the case where the switching device is closed, the main gear 5 is rotated by restoration force exerted by the closing spring 22, and the intermediate gear 33 is separated from the main gear 5 due to the elongated hole 35 that supports the rotation axle 25 thereof; and in the case where the closing spring 22 is energized again, the intermediate gear 33 is again engaged with the main gear 5 due to the elongated hole 35 that supports the rotation axle 25 thereof.

4 Claims, 9 Drawing Sheets

(a)

(b)

VIEW TAKEN ALONG ARROW G (c)

VIEW TAKEN ALONG ARROW H

DURING ENERGIZATION OF SPRING
(a)

MAIN GEAR AT BOTTOM DEAD CENTER
(b)

UPON COMPLETION
OF SPRING ENERGIZATION

DURING CLOSING

REVERSE ROTATION PREVENTED
BY ONE-WAY CLUTCH

PREVENTION
OF REVERSE ROTATION

ENERGY STORAGE MECHANISM FOR SWITCHING DEVICE

TECHNICAL FIELD

The present invention relates to a mechanism for storing energy in a closing spring that makes an electric power switch such as a circuit breaker or a switching device perform closing operation.

BACKGROUND ART

Among switching devices such as circuit breakers, there exists a switching device in which, upon closing, restoration force exerted by a spring is utilized in order to rapidly and steeply perform the closing operation, or more specifically, the approaching operation of a movable contact to a fixed contact; the movable contact and the fixed contact configure a contact point (main contact point) In a switching device of this type, prior to the closing operation, the closing spring is energized by contraction or tension and the closing spring is restrained in this state; upon the closing, a contact closing lever, connected with the contact, is operated through restoration force exerted by the closing spring that is released due to cancellation of the restraint so that the movable contact is moved at high speed.

Various kinds of configurations of an energy storage mechanism for storing energy in the closing spring have been proposed along with various kinds of configurations of a stored-energy release mechanism. FIG. 7 is a side cross-sectional view illustrating the principal parts of an energy storage mechanism disclosed in Patent Document 1.

The energy storage mechanism is provided with a main shaft 1, an energy storage shaft 2, and an energy storage motor 3 that are commonly supported by a supporting frame 4 in such a way as to be approximately parallel to one another. The main shaft 1 holds in a fitting manner a large gear 5 at the protrusion end thereof protruding from one side of the supporting frame 4 and a closing cam 6 at the middle portion thereof; the large gear 5 and the closing cam 6 rotate on the main shaft 1 as the main shaft 1 rotates.

On the outer side of the large gear 5, a crank pin 7 is provided in a protruding manner at a position that is eccentric by an appropriate distance from the center axis of the main shaft 1. One end of a press rod 8 is coupled with the crank pin 7; the other end of the press rod 8 is supported in an insertion manner by a spring plate 9. The spring plate 9 is a fixed plate that is integrally provided in a protruding manner, for example, at the outside of the supporting frame 4; a closing spring 22 is inserted between the spring plate 9 and a press plate 10 that is fixed to the middle portion of the press rod 8.

As illustrated in FIG. 7, when, due to the rotation of the large gear 5, the protrusion portion of the crank pin 7 becomes close to the spring plate 9, the closing spring 22, inserted between the spring plate 9 and the press plate 10, is contracted, thereby storing energy. The foregoing energy storage state is maintained by restraining the rotation position of the large gear 5 by unillustrated restraining means; when the restraint is released, the spring force by the closing spring 22 is exerted on the large gear 5 via the press plate 10, the press rod 8, and the crank pin 7, so that the main shaft 1 rotates at high speed, along with the large gear 5.

Inside the supporting frame 4, a contact closing lever 11 is pivotably supported through the intermediary of a supporting axle 12 that is provided in a protruding manner at one side thereof. On the other side of the contact closing lever 11, there is supported a roller 13 that makes contact in a rolling manner with the cam surface, i.e., the circumference of the closing cam 6; through the operation of the roller 13 that follows the cam surface, the contact closing lever 11 pivots on the supporting axle 12 in accordance with the rotation of the closing cam 6; the contact closing lever is connected with an unillustrated contact in such a way as to perform closing operation through the pivoting.

The energy storage shaft 2 is provided with a transmission gear 14 that is integrally fixed to the protrusion end thereof protruding from one side of the supporting frame 4 and a driving gear 15 that is loosely inserted between the transmission gear 14 and the outer surface of the supporting frame 4. The transmission gear 14 is engaged with a large gear 5 fixed to the end portion of the main shaft 1; the driving gear 15 is engaged with an output gear 16 into which the output end of the energy storage motor 3 is inserted.

The energy storage motor 3 is a geared motor in which the rotation of a motor main body 3*a* is outputted after being decelerated by a speed reducer 3*b* consecutively arranged at the output side of the motor main body 3. An output shaft 17 of the speed reducer 3*b* is inserter into the output gear 16; a one-way clutch 18*a* that allows rotation only in a single direction is inserted between the output shaft 17 and the housing of the speed reducer 3*b*.

Via a nail clutch 19 and the one-way clutch 18*b* inserted into a hole that penetrates the center axis portion of the driving gear and holds the one-way clutch 18*b*, the driving gear 15 engaged with the output gear 16 fits around the energy storage shaft 2, in such a way as to be relatively rotatable and slidable in the axis direction of the energy storage shaft 2; the driving gear 15 is biased toward the transmission gear 14 by a press spring 20 inserted between the outer surface of the supporting frame 4 and the driving gear 15. The one-way clutch 18*b* provided in the driving gear 15 allows rotation in the same direction as the one-way clutch 18*a* provided in the speed reducer 3*b* allows, and conveys the rotation, of the driving gear 15, transmitted from the output gear 16 to the nail clutch 19 inside thereof. On the other hand, in the case of the reverse rotation transmitted from the nail clutch 19, a slide is caused.

In normal time, the driving gear 15 is pressed against the transmission gear 14 through spring force exerted by the press spring 20 that elastically makes contact with the outer surface of the supporting frame 4 and rotates along with the transmission gear 14 through the engagement operation of the nail clutch 19. The foregoing engagement state is released in such a way that, when the main shaft 1 and the large gear 5 are situated in the respective rotation positions illustrated in FIG. 7 and energy is being stored in the closing spring 22, the driving gear 15 is pressed by a press protrusion 21 provided in a protruding manner at a position, on the other side of the large gear 5, that is approximately and radially symmetric with the crank pin 7, whereby the driving gear 15 resists against the spring force exerted by the press spring 20 and departs from the transmission gear 14.

In the conventional energy storage mechanism configured as described above, when, in the state illustrated in FIG. 7, the restraint of the large gear 5 is released, the large gear 5 rotates at high speed in a predetermined direction (the same as the direction in which the closing spring 22 is energized), due to the release of the restoration force exerted by the closing spring 22; this rotation is conveyed to the contact closing lever 11 via the closing cam 6, whereby the contact closing lever 11 pivots at high speed, so that the unillustrated contact is closed.

During the foregoing closing operation, the rotation of the large gear 5 is conveyed to the transmission gear 14 that is engaged with the large gear, so that the energy storage shaft 2 rotates; however, because this rotation direction causes a slide of the one-way clutch 18*b* incorporated in the driving gear 15, the driving gear 15 does not rotate, whereby the rotation force is not conveyed to the output shaft 17 of the energy storage motor 3.

While, due to the inertia of the large gear 5, the rotation, of the large gear 5, caused by restoration of the closing spring 22 continues in such a way as to exceed a predetermined rotation position (top dead center), the closing spring 22 is energized; thus, the large gear 5 and the main shaft 1 try to reverse the rotation after the top dead center has been reached. However, this reverse-rotation force is conveyed to the one-way clutch 18*b* incorporated in the driving gear 15 via the transmission gear 14; due to the engagement of the one-way clutch 18*b*, the reverse-rotation force is conveyed to the driving gear 15; and the reverse-rotation force is further conveyed to the output shaft 17 of the energy storage motor 3 via the output gear 16, and the one-way clutch 18*a* that is mounted around the output shaft 17 is engaged with the output shaft 17. As a result, the reverse rotation is hindered, and the large gear 5 is restrained at the rotation position where the large gear 5 has reached the top dead center.

When, after the foregoing closing state is obtained, the energy storage motor 3 is driven to rotate, this rotation is conveyed to the driving gear 15 via the output gear 16 fit around the output shaft 17; the rotation is further conveyed to the transmission gear 14 via the nail clutch 19; and the large gear 5 engaged with the transmission gear 14 rotates. Due to the rotation of the large gear 5, the press rod 8 coupled with the crank pin 7 is depressed; the closing spring 22 between the press plate 10 and the spring plate 9 is contracted, and the illustrated energy storage state is obtained; as a result, there is prepared a state in which the next closing operation is allowed. At a predetermined rotation position of the large gear 5, the press protrusion 21 presses the driving gear 15, thereby releasing the engagement of the nail clutch 19, so that the rotation, of the large gear 5, caused by the rotation of the energy storage motor 3 is interrupted; the predetermined rotation position is maintained through the restraint of the large gear 5 by the restraining means.

(Patent Document 1) Japanese Patent Application Laid-Open No. H11-40010

DISCLOSURE OF THE INVENTION

Problems to be Solved by the Invention

In the conventional energy storage mechanism configured as described above, in order to store energy in the closing spring 22, the output gear 16 is rotated by the energy storage motor 3 as a driving source or through a manual rotation, and the rotation is conveyed to the driving gear 15, the transmission gear 14, and the large gear 5 in that order, so that the closing spring 22 coupled with the large gear 5 is energized. After energy has been stored in the closing spring 22, the driving gear 15 is moved by the press protrusion 21 mounted on the large gear 5, thereby releasing the nail clutch 19, so that excess energy storage is prevented. After the closing operation, the nail clutch 19 is coupled again by means of the press spring 20. The one-way clutch prevents the large gear 5 from reversing its rotation.

However, in order to satisfy the foregoing functions, there is required a dimensional accuracy with which the press protrusion 21 on the large gear 5 makes contact with the driving gear 15, thereby releasing the nail clutch 19; therefore, there has been a problem that, for the purpose of re-coupling, the end shape of the nail clutch 19 should be formed accurately.

The present invention has been implemented in order to solve the foregoing problems; the objective thereof is to obtain an energy storage mechanism, for a switching device, that has a structure requiring no high-accuracy components and can perform the re-engagement and the release of driving-power transmission.

Means for Solving the Problems

An energy storage mechanism for a switching device according to the present invention is provided with a main gear that has a closing cam for performing closing of a contact of the switching device and a crank portion connected with a closing spring, that is rotated by an energy storage motor or manually, that is rotated by restoration force exerted by the closing spring in the same direction as the closing spring is energized through an action of the crank portion, and that makes the switching device perform closing operation through an action of the closing cam, the main gear including a gear A all the teeth of which are sound and a gear B having a missing-tooth portion that are integrally assembled in such a way that all the teeth of the gear A and all the teeth of the gear B are in phase; an output gear that is rotated through an output shaft that is driven by the energy storage motor or manually; an intermediate gear that is engaged with the output gear as well as the gear B and whose rotation axle is supported in a rotation direction of the main gear by an elongated hole provided on the circumference of a circle with respect to the output shaft; and a reverse rotation prevention mechanism for the main gear. In the case where the closing spring is energized, the main gear is rotated by the energy storage motor or manually, via the output gear and the intermediate gear; in the case where the closing spring has been energized, the engagement between the intermediate gear and the main gear is released at the missing-tooth portion of the gear B; in the case where the switching device is closed, the main gear is rotated by restoration force exerted by the closing spring, and the intermediate gear is separated from the main gear due to the elongated hole that supports the rotation axle thereof; and in the case where the closing spring is energized again, the intermediate gear is again engaged with the main gear due to the elongated hole that supports the rotation axle thereof.

Advantages of the Invention

In an energy storage mechanism for a switching device according to the present invention, when the closing spring has been energized, the engagement between the intermediate gear and the main gear is released at the missing-tooth portion of the gear B; therefore, interruption of driving-power transmission can be performed through a simple structure that requires no high-accuracy components. Moreover, the rotation axle of the intermediate gear is supported in the rotation direction of the main gear by an elongated hole provided on the circumference of a circle with respect to the output shaft of the output gear; therefore, in the closing process, the intermediate gear is separated from the gear B due to the elongated hole, and when the closing spring is energized again, the intermediate gear can be engaged again with the gear B of the main gear, due to the elongated hole.

Other objects, features, aspects, and advantages of the present invention will become more apparent from the following detailed description of the present invention when taken in conjunction with the accompanying drawings.

BEST MODE FOR CARRYING OUT THE INVENTION

Embodiment 1

Figure 1:
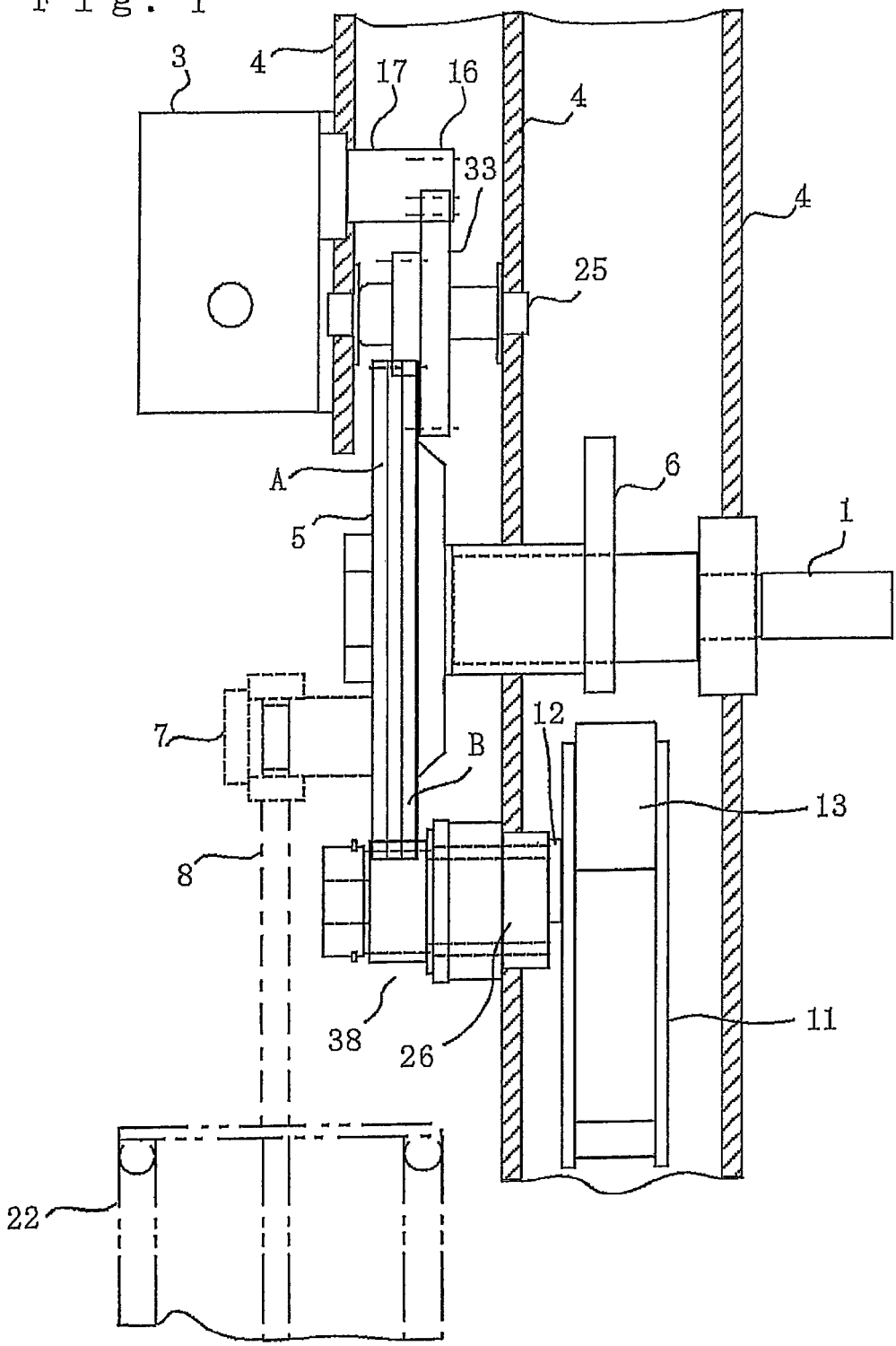
FIG. 1 is a side cross-sectional view illustrating principal parts of an energy storage mechanism, for a switching device, according to Embodiment 1 of the present invention.
Figure 2:
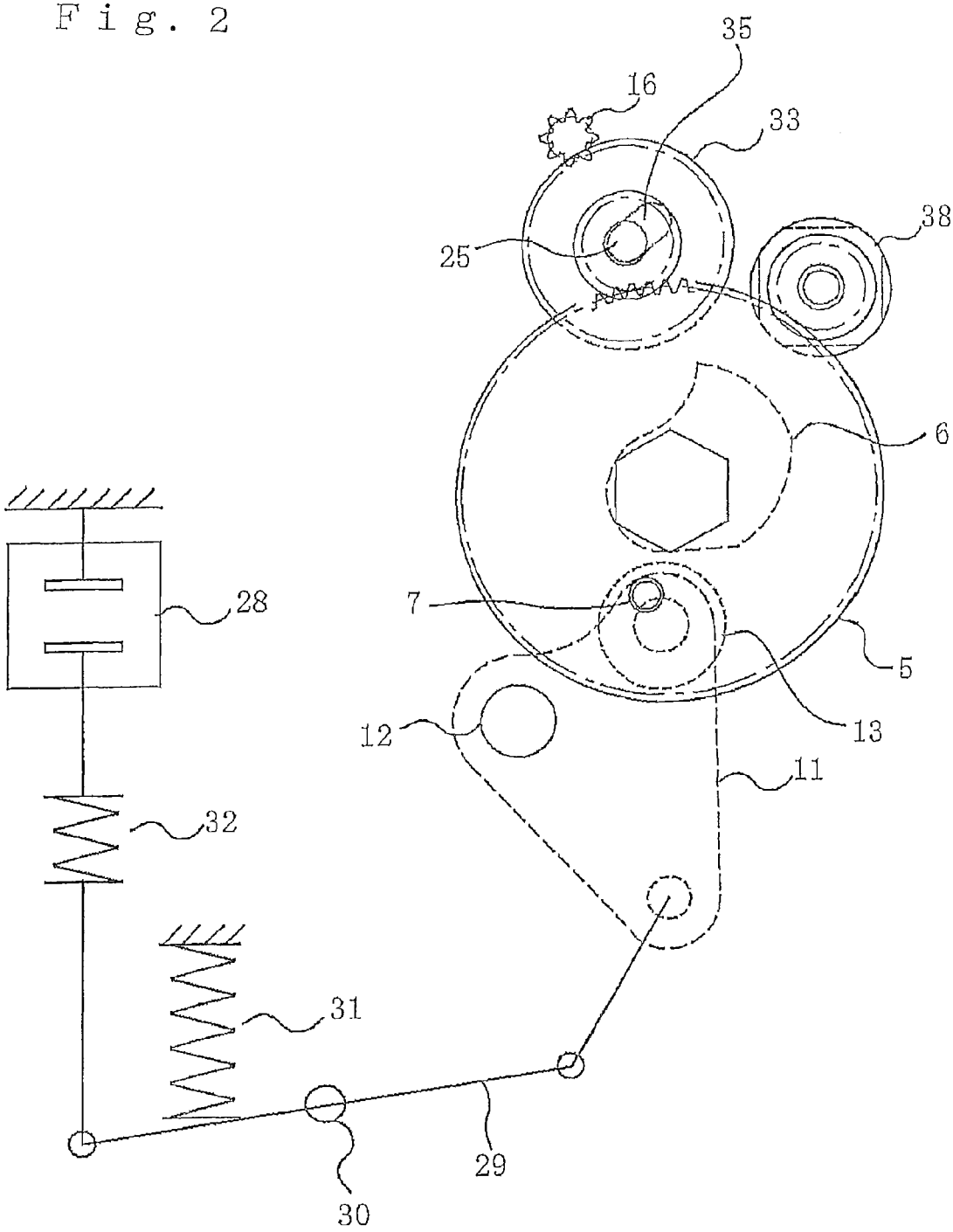
FIG. 2 is a diagram for explaining the main configuration of the energy storage mechanism for a switching device illustrated in FIG. 1.

FIG. 1 is a side cross-sectional view illustrating principal parts of an energy storage mechanism, for a switching device, according to Embodiment 1 of the present invention. FIG. 2 is a diagram for explaining the main configuration of the energy storage mechanism for a switching device as well as for explaining a state in which a closing spring has been energized. The same reference marks in the figures indicate the same or equivalent constituent elements. The energy storage mechanism is provided with a main shaft 1, a rotation axle 25, an output shaft 17, and a shaft 26 of a reverse rotation prevention gear that are commonly supported by a supporting frame 4 in such a way as to be approximately parallel to one another. The main shaft 1 holds in a fitting manner a main gear (large gear) 5 at the protrusion end thereof protruding from one side of the supporting frame 4 and a closing cam 6 at the middle portion thereof; the main gear 5 and the closing cam 6 rotate on the main shaft 1 as the main shaft 1 rotates.

Figure 7:
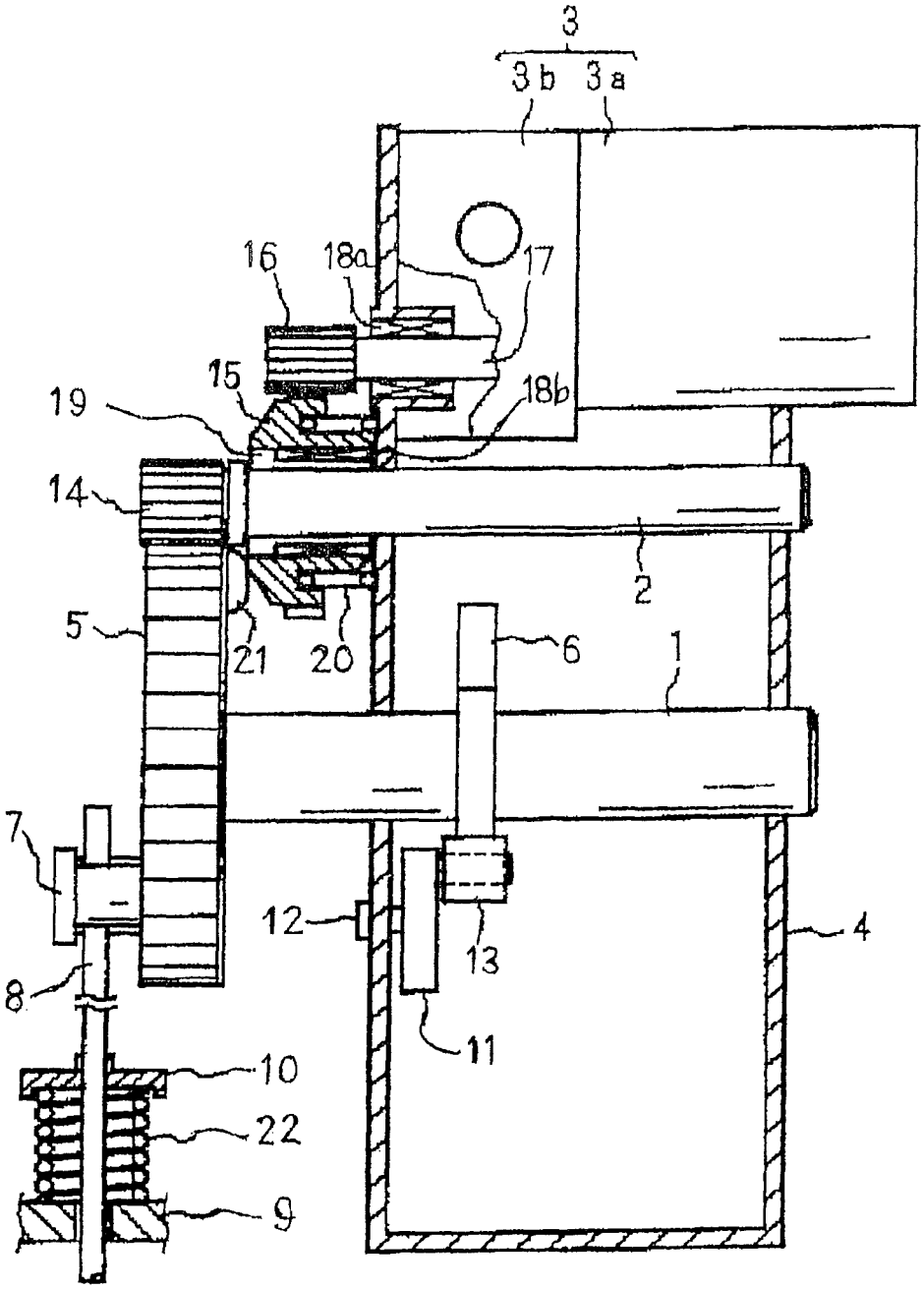
Fig. 7 (PRIOR ART)
FIG. 7 is a view illustrating principal parts of a conventional energy storage mechanism for a switching device.

On the outer side of the main gear 5, a crank pin 7 is provided in a protruding manner at a crank portion that is eccentric by an appropriate distance from the center axis of the main shaft 1. One end of a press rod 8 is coupled with the crank pin 7; by depressing the press rod 8, a closing spring 22 is contracted and energized, as is the case with FIG. 7. Due to the rotation of the main shaft 1, the crank portion of the main shaft 1 moves up and down, thereby restoring and contracting the closing spring 22.

When, due to the rotation of the main gear 5, the protrusion portion of the crank pin 7 becomes close to the closing spring 22, the closing spring 22 is contracted so as to store energy. The foregoing energy storage state is maintained by restraining the rotation position of the main gear 5 by a restraining means 27 (illustrated in FIG. 6); when the restraint is released, the spring force by the closing spring 22 is exerted on the main gear 5 via the press rod 8 and the crank pin 7, so that the main shaft 1 rotates at high speed, along with the main gear 5.

Inside the supporting frame 4, a contact closing lever 11 is pivotably supported through the intermediary of a supporting axle 12 that is provided at one side thereof. On one end of the contact closing lever 11, there is supported a roller 13 that makes contact in a rolling manner with the cam surface, i.e., the circumference of the closing cam 6; through the operation of the roller 13 that follows the cam surface, the contact closing lever 11 pivots on the supporting axle 12 in accordance with the rotation of the closing cam 6; the contact closing lever 11 is connected with a contact 28 in such a way as to perform closing operation through the pivoting. In FIG. 2, a link mechanism 29 that makes the contact 28 operate is connected with the contact closing lever 11; reference numerals 30, 31, and 32 denote a supporting axle, a release spring, and a contact pressure spring, respectively.

The output shaft 17 is rotated by the energy storage motor 3 that provides driving force; an output gear 16 fit in the output shaft 17 is rotated; the rotation of the output gear 16 is conveyed to the main gear 5 via an intermediate gear 33; and the closing spring 22 coupled with the main gear 5 is energized. The output shaft 17 may manually be rotated by use of a wrench or the like, instead of the energy storage motor 3. In the main gear 5, a gear A all the teeth of which are sound and a gear B having a missing-tooth portion 34 are integrally assembled in such a way that all the teeth of the gear A and all the teeth of the gear B are in phase; all the teeth of the gears A and the gear B excluding the missing-tooth portion 34 have the same shape.

Figure 3:
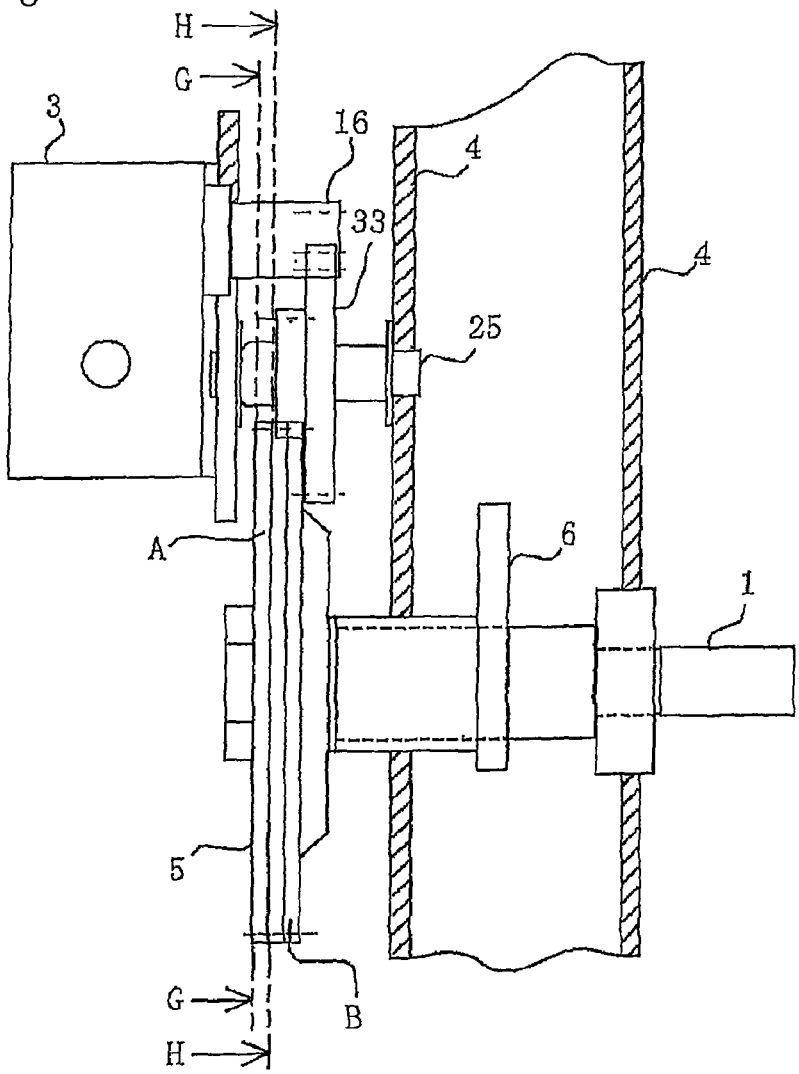
FIG. 3 is a set of diagrams for explaining a main-gear configuration according to Embodiment 1.
Figure 3:
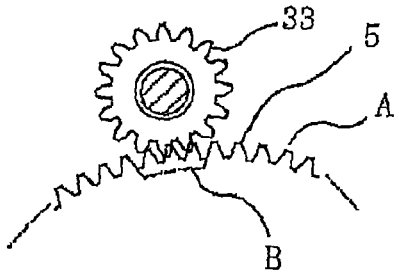
Figure 3:
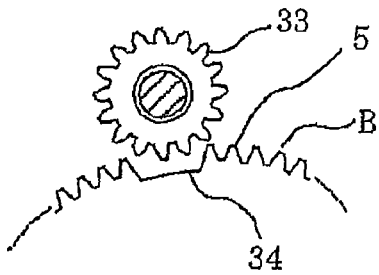

FIG. 3 is a set of diagrams for explaining the configuration of the main gear 5 according to Embodiment 1 as well as for explaining a state in which the closing spring has been energized. FIG. 3(*b*) illustrates a cross-sectional view of the gear A of the main gear 5, taken along the arrow G-G in FIG. 3(*a*). FIG. 3(*c*) illustrates a cross-sectional view of the gear B of the main gear 5, taken along the arrow H-H in FIG. 3(*a*). As can be seen from FIG. 3(*b*), the gear A is a gear all the teeth of which are sound. The gear B is assembled integrally with the gear A in such a way that all the teeth thereof and all the teeth of the gear A are in phase, although part of the teeth thereof are cut out so as to form the missing-tooth portion 34. The gear B is configured with two sheet-metal gear plates that are adhered to each other; however, it may be configured with three, four, or more gear plates, depending on the weight of a single gear plate. The main gear 5 is configured with a gear plate, in which the gear A is formed of sheet plates, and a gear plate, in which the gear B is formed of sheet plates, that are integrally adhered to and combined with each other in such a way that all the teeth of the gear A and all the teeth of the gear B are in phase.

The intermediate gear 33 configured with a large-diameter gear and a small-diameter gear that are integrated with each other is engaged with the output gear 16 and with the gear B out of the main gear 5; after the closing spring 22 has been energized, the driving-power transmission between the intermediate gear 33 and the gear B is interrupted by the missing-tooth portion 34 of the gear B. Accordingly, after the closing spring 22 has been energized, the intermediate gear 33 is separated from the main gear 5; thus, the driving force exerted by the energy storage motor 3 is not conveyed to the main gear 5. As a result, excess energy storage is prevented.

Figure 4:
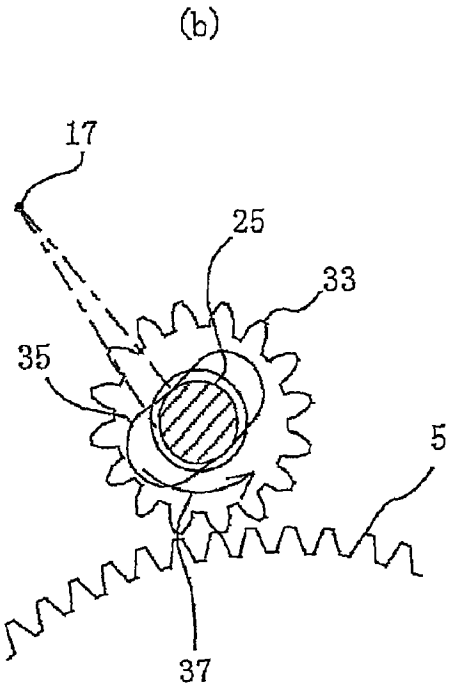
FIG. 4 is a set of diagrams for explaining an elongated hole that supports the rotation axle of an intermediate gear according to Embodiment 1.
Figure 4:
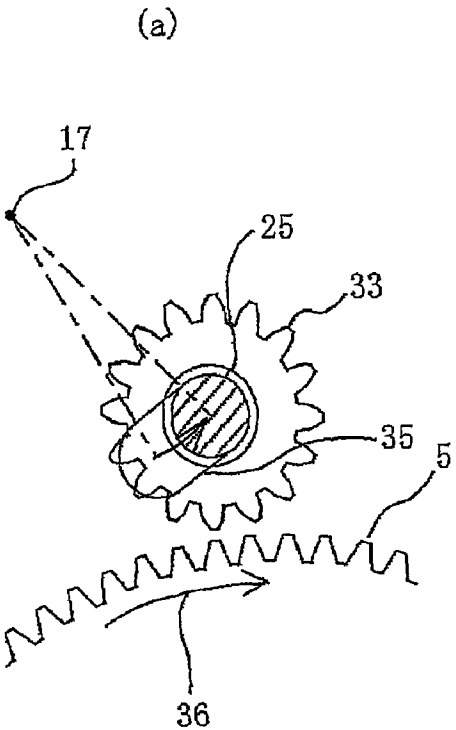

FIG. 4 is a set of diagrams for explaining an elongated hole that supports the rotation axle of the intermediate gear according to Embodiment 1. The rotation direction of the rotation axle 25 of the intermediate gear 33 is the same as the rotation direction (direction of the action caused by the rotation) of the main gear 5, and the rotation axle 25 is supported by an elongated hole 35 provided on the circumference of an circle with respect to the output shaft 17 of the output gear 16 that is engaged with the intermediate gear 33; therefore, the intermediate gear 33 is not separated from the output gear 16. The respective elongated holes 35 are formed in the supporting frames 4 at both ends thereof.

FIG. 4(*a*) is a diagram for explaining the state in which the contact is closed; the arrow 36 indicates the direction in which the main gear 5 rotates as the contact is closed. Because, while the contact is closed, the intermediate gear 33 is not rotating, the intermediate gear 33 is kicked through the rotation of the main gear 5; therefore, the rotation axle 25 of the intermediate gear 33 travels upward in the elongated hole 35, and the intermediate gear 33 is separated from the main gear 5; thus, the intermediate gear 33 does not hinder the rotation of the main gear 5. FIG. 4(*b*) is a diagram for explaining the state in which the intermediate gear and the main gear are engaged with each other again; the arrow 37 indicates the direction in which the intermediate gear 33 rotates as the re-engagement is performed. While the re-engagement is performed, due to its own weight, an action caused by the rotation of the output gear 16, the effect of a restoring spring (unillustrated), and the like, the rotation axle 25 of the intermediate gear 33 travels downward in the elongated hole 35 to be engaged with the main gear 5 again, so that the rotation of the output gear 16 is conveyed to the main gear. In this situation, although the rotation axle 25 may travel back to the upper position in the elongated hole 35 when the teeth edges of the intermediate gear 33 butt the teeth edges of the main gear 5, the rotation axle 25 again travels downward in the elongated hole 35 so as to be engaged with the main gear 5 again.

In FIG. 1, reference numeral 38 denotes a reverse rotation prevention gear that is held and fixed in the supporting frame 4 and has a one-way clutch fit around a shaft; the reverse rotation prevention gear 38 is engaged with the gears A and B of the main gear 5 so as to prevent the main gear 5 from reversing its rotation. The reverse rotation prevention gear 38 is always engaged with the gear A, but its engagement with the gear B may be released at the missing-tooth portion of the gear B; however, because its engagement with the gear A is maintained, the teeth edges of the reverse rotation prevention gear 38 does not butt the teeth edges of the gear B, whereby the reverse rotation prevention gear 38 is engaged with the gear B again. In addition, in FIG. 2, for the better illustration, the reverse rotation prevention gear 38 is illustrated at a position that is different from its position in FIG. 1.

Figure 5:
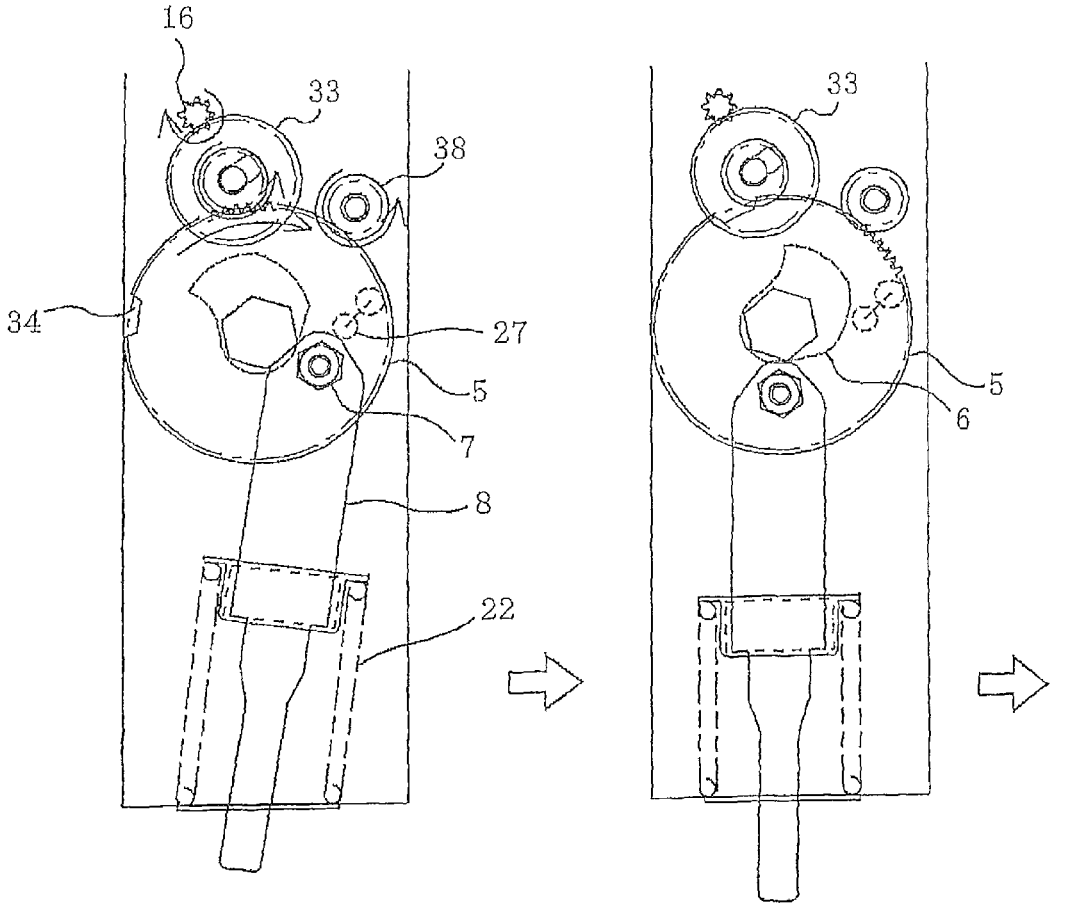
FIG. 5 is a set of diagram for explaining the operation of an energy storage mechanism, for a switching device, according to Embodiment 1.
Figure 6:
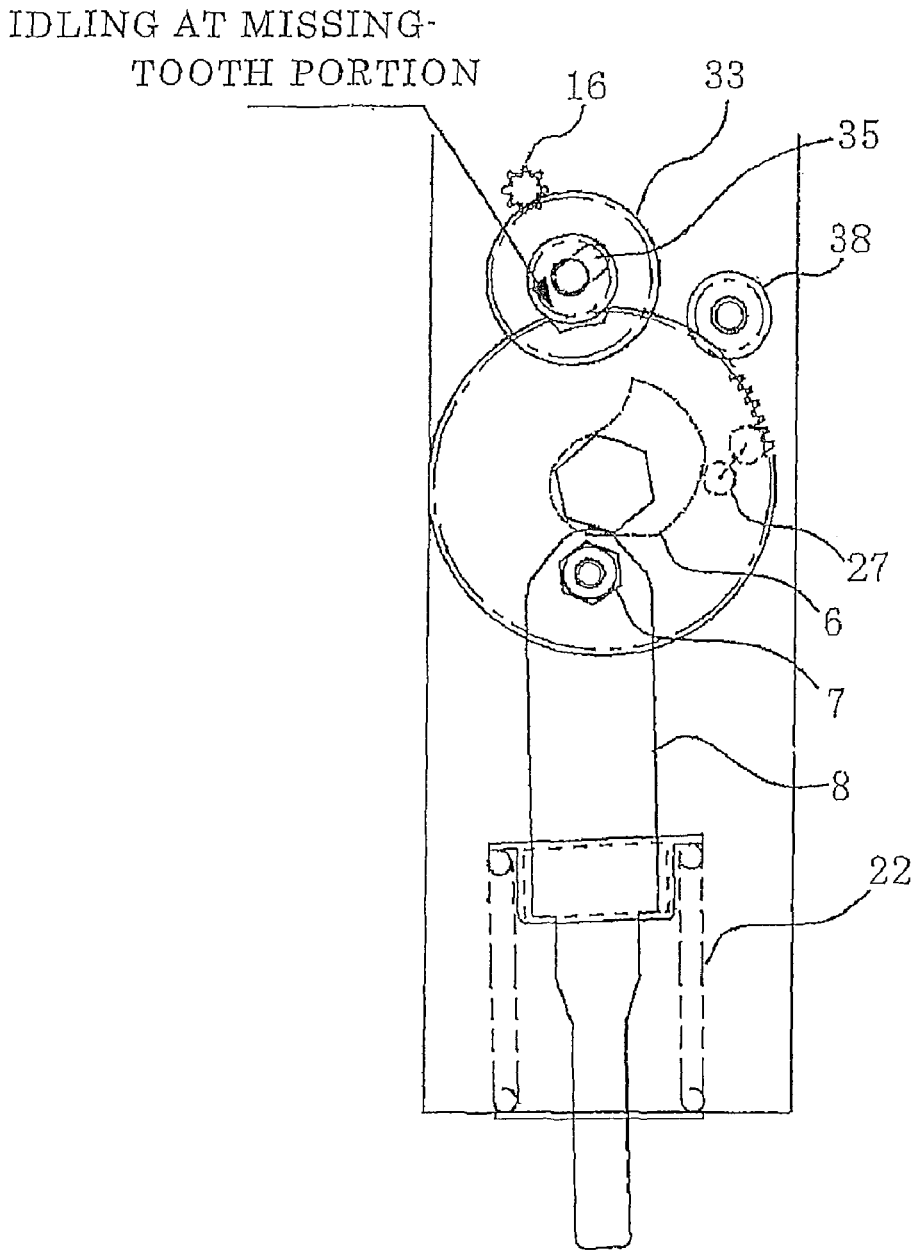
FIG. 6 is a set of diagram for explaining the operation of an energy storage mechanism, for a switching device, according to Embodiment 1.
Figure 6:
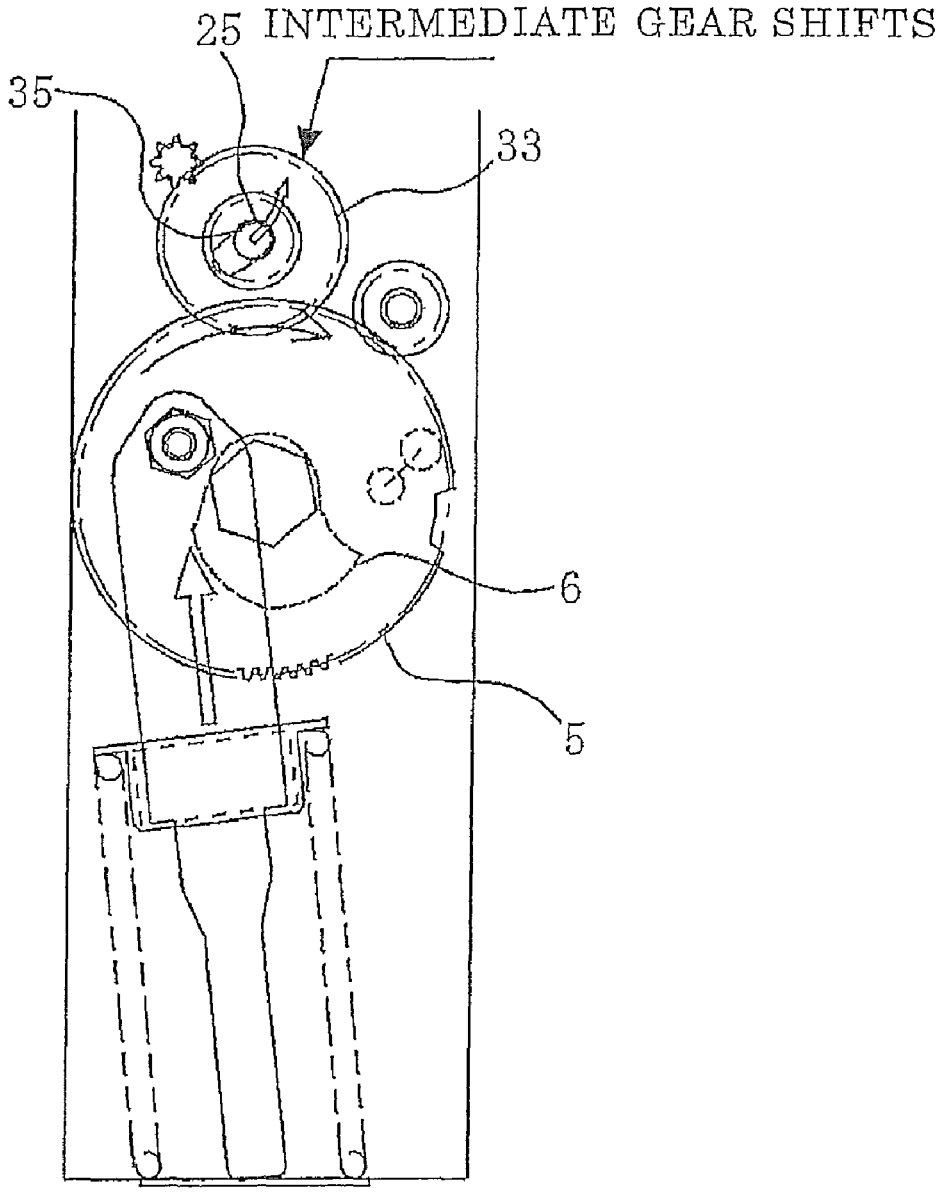
Figure 6:
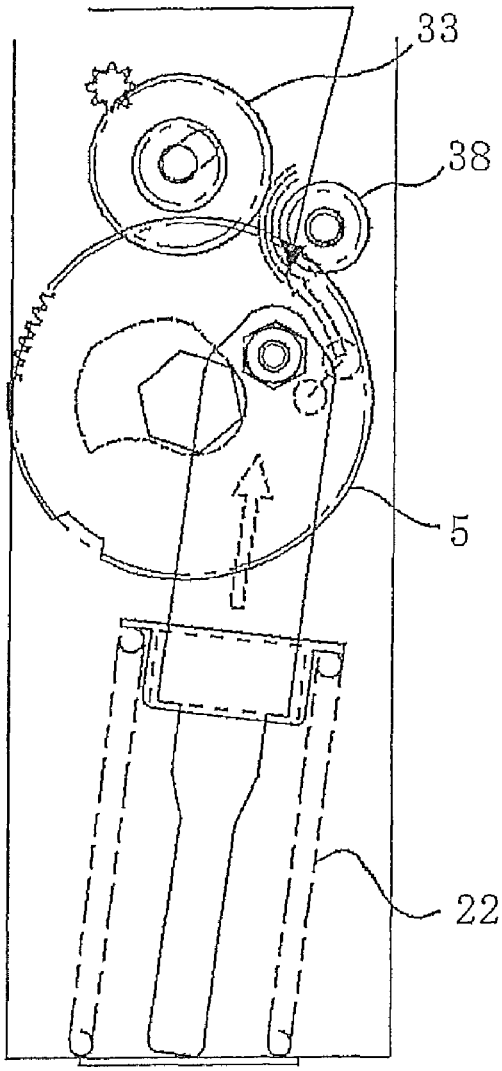

Next, the operation of the energy storage mechanism will be explained. FIGS. 5 and 6 are each a set of diagrams for explaining the operation of the energy storage mechanism for a switching device according to Embodiment 1; FIGS. 5(*a*), 5(*b*), 6(*a*), 6(*b*), and 6(*c*), as a whole, illustrate the operation of a single rotation of the main gear 5. Each of the solid-line arrows in FIGS. 5 and 6 indicates the rotation direction of the gear. FIG. 5(*a*) illustrates a state in which the closing spring is being energized; the driving force by the output gear 16 makes the main gear 5 rotate via the intermediate gear 33. The intermediate gear 33 is engaged with the gear B of the main gear 5 so as to make the main gear 5 rotate, and the crank portion is depressed, so that the closing spring 22 is energized. In this situation, the reverse rotation prevention gear 38 engaged with the main gear 5 rotates along with the main gear 5, because the main gear 5 rotates forward. Because the intermediate gear 33 conveys the driving force by the output gear 16 to the main gear 5, the rotation axle 25 of the intermediate gear 33 travels downward in the elongated hole 35 and is supported by the elongated hole 35.

FIG. 5(*b*) illustrates the main gear 5 in a state of the bottom dead center; the intermediate gear 33 is engaged with the main gear 5 at a position immediately before the missing-tooth portion 34 of the gear B. FIG. 6(*a*) illustrates a state in which the closing spring has been energized. In this situation, because the intermediate gear 33 has reached the missing-tooth portion 34 of the gear B of the main gear 5, the engagement between the intermediate gear 33 and the main gear 5 is released; thus, the driving force by the output gear 16 is not conveyed to the main gear 5, whereby the inertia of the energy storage motor 3 is not transmitted to the main gear 5. The energy storage state of the closing spring 22 is maintained by restraining the rotation position of the main gear 5 by the restraining means 27.

When the restraint is released, the spring force by the closing spring 22 is exerted on the main gear 5 via the press rod 8 and the crank pin 7, whereby the main shaft 1 begins to rotate along with the main gear 5. At this time, the intermediate gear 33 tries to be engaged with the gear B again, at a position after the missing-tooth portion 34. However, when the gear B exerts force on the intermediate gear 33 in such a way as to make the intermediate gear 33 to rotate, due to the effect of the elongated hole 35, the rotation axle 25 of the intermediate gear 33 rotates around the output shaft 17 of the output gear 16 and travels upward in the elongated hole 35 in such a way as to depart from the gear B; therefore, the intermediate gear 33 does not hinder the main gear 5 from rotating. FIG. 6(*b*) illustrates a state in which the closing contact is being closed. In addition, in FIG. 6(*b*), the upper white arrow indicates a direction in which the rotation axle 25 of the intermediate gear 33 travels; the lower white arrow indicates a direction in which the closing spring 22 is restored. In such a way as described above, through the operation of the closing cam 6 caused by the rotation of the main shaft 1 of the main gear 5, the contact of the switching device is closed.

While, due to the inertia of the main gear 5, the rotation, of the main gear 5, caused by restoration of the closing spring 22 continues in such a way as to exceed a predetermined rotation position (top dead center), the closing spring 22 is energized; thus, the main gear 5 and the main shaft 1 try to reverse the rotation after the top dead center has been reached. However, the reversing force is hindered by the reverse rotation prevention gear 38 that is engaged with the main gear 5 at a position different from the position where the reverse rotation prevention gear 38 is engaged with the intermediate gear 33. As a result, the main gear 5 is restrained at the rotation position where the large gear 5 has reached the top dead center. FIG. 6(*c*) illustrates a state in which the main gear 5 is hindered from reversing its rotation. In addition, in FIG. 6(*c*), the upper white arrow indicates a direction in which the main gear 5 tries to reverse its rotation; the lower white arrow indicates a direction in which the closing spring 22 is restored.

When, after the completion of the closing, the intermediate gear 33 is again engaged with the main gear 5 so as to resume the energization of the closing spring 22, the teeth of the intermediate gear 33 may butt the teeth of the main gear 5. However, the direction in which, with respect to the main gear 5, the intermediate gear 33 has traveled along the elongated hole 35 and the rotation direction of the intermediate gear 33 are opposite to each other; thus, the tooth-edge butting does not occur, and after, due to the elongate hole 35, the intermediate gear 33 once departs from the main gear 5, the intermediate gear 33 can securely be engaged with the main gear 5.

In the energy storage mechanism configured as described above, when the closing spring 22 has been energized, the engagement between the intermediate gear 33 and the main gear 5 is released at the missing-tooth portion 34 of the gear B; therefore, the interruption of driving-power transmission can be performed through a simple structure that requires no high-accuracy components for obtaining the positional accuracy in the interruption. The reverse rotation prevention gear 38 is always engaged with the gear A; therefore, in the case where, after the engagement between the gear B and the reverse rotation prevention gear 38 is once released due to the missing-tooth portion 34 of the gear B, the gear B and the reverse rotation prevention gear 38 try to be again engaged with each other, the teeth of the gear B and the teeth of the reverse rotation prevention gear 38 are in phase, whereby the tooth-edge butting can be prevented through a simple structure that requires no high-accuracy components.

While the contact of the switching device is being closed, the main gear 5 is rotated through the energy stored in the closing spring 22, whereby the intermediate gear 33 becomes subordinate. In the closing process, when the gear B is again engaged with the intermediate gear 33, at a position after the missing-tooth portion 34, the gear B exerts force on the intermediate gear 33 in the action-line direction (rotation direction); due to the effect of the elongated hole 35, the rotation axle 25 of the intermediate gear 33 rotates around the output shaft 17 of the output gear 16; and the intermediate gear 33 is separated from the gear B. As a result, the tooth-edge butting can be prevented through a structure that requires no high-accuracy components.

After the closing has been completed, due to its own weight and the rotation of the intermediate gear 33 caused by the output gear, the rotation axle 25 of the intermediate gear 33 travels downward along the elongated hole 35; even in the case where the tooth-edge butting occurs when the intermediate gear 33 and the gear B try to be again engaged with each other, the direction in which, with respect to the gear B, the intermediate gear 33 has traveled along the elongated hole 35 and the rotation direction of the intermediate gear 33 are opposite to each other; thus, no mutual pushing caused by tooth-edge butting does not occur, and even if the tooth-edge butting occurs, it is made possible that, after, due to the elongate hole 35, the intermediate gear 33 once departs from the main gear 5, the intermediate gear 33 is securely engaged with the main gear 5.

Various modifications and alterations of this invention will be apparent to those skilled in the art without departing from the scope and spirit of this invention, and it should be understood that this is not limited to the illustrative embodiments set forth herein.

The invention claimed is:

1. An energy storage mechanism for a switching device, comprising:

a main gear that has a closing cam for performing closing of a contact of the switching device and a crank portion connected with a closing spring, that is rotated by an energy storage motor or manually, that is rotated by restoration force exerted by the closing spring in the same direction as the closing spring is energized through an action of the crank portion, and that makes the switching device perform closing operation through an action of the closing cam, the main gear including a gear A all the teeth of which are sound and a gear B having a missing-tooth portion that are integrally assembled in such a way that all the teeth of the gear A and all the teeth of the gear B are in phase;

an output gear that is rotated through an output shaft that is driven by the energy storage motor or manually;

an intermediate gear that is engaged with the output gear as well as the gear B and whose rotation axle is supported in a rotation direction of the main gear by an elongated hole provided on the circumference of a circle with respect to the output shaft; and a reverse rotation prevention mechanism for the main gear, wherein, in the case where the closing spring is energized, the main gear is rotated by the energy storage motor or manually, via the output gear and the intermediate gear; in the case where the closing spring has been energized, the engagement between the intermediate gear and the main gear is released at the missing-tooth portion of the gear B; in the case where the switching device is closed, the main gear is rotated by restoration force exerted by the closing spring, and the intermediate gear is separated from the main gear due to the elongated hole that supports the rotation axle thereof; and in the case where the closing spring is energized again, the intermediate gear is again engaged with the main gear due to the elongated hole that supports the rotation axle thereof.

2. The energy storage mechanism for a switching device according to claim 1, wherein the reverse rotation prevention mechanism for the main gear is a reverse rotation prevention gear that is engaged with at least the gear A of the main gear and includes a one-way clutch.

3. The energy storage mechanism for a switching device according to claim 1, wherein the main gear is configured with a gear plate for forming the gear A and a gear plate for forming the gear B that are integrally combined in such a way that the teeth of the gear A and the teeth of the gear B are in phase.

4. The energy storage mechanism for a switching device according to claim 2, wherein the main gear is configured with a gear plate for forming the gear A and a gear plate for forming the gear B that are integrally combined in such a way that the teeth of the gear A and the teeth of the gear B are in phase.

* * * * *